United States Patent [19]

Parkes

[11] 4,127,358

[45] Nov. 28, 1978

[54] BLADE OR VANE FOR A GAS TURBINE ENGINE

[75] Inventor: Roger J. Parkes, Stanton-by-Bridge, England

[73] Assignee: Rolls-Royce Limited, London, England

[21] Appl. No.: 784,369

[22] Filed: Apr. 4, 1977

[30] Foreign Application Priority Data

Apr. 8, 1976 [GB] United Kingdom ..... 14221/76

[51] Int. Cl.[2] ..... F01D 5/18

[52] U.S. Cl. ..... 416/97 R; 416/191

[58] Field of Search ..... 416/96, 97, 191

[56] References Cited

U.S. PATENT DOCUMENTS

| | | | |
|---|---|---|---|
| 3,606,574 | 9/1971 | Brands et al. | 416/97 X |
| 3,876,330 | 4/1975 | Pearson et al. | 416/97 X |
| 4,017,209 | 4/1977 | Bodman | 416/97 R |

FOREIGN PATENT DOCUMENTS

| | | | |
|---|---|---|---|
| 2,275,975 | 1/1976 | France | 416/191 |
| 584,580 | 1/1947 | United Kingdom | 416/191 |
| 1,276,200 | 6/1972 | United Kingdom | 416/191 X |
| 1,285,369 | 8/1972 | United Kingdom | 416/191 |
| 1,426,049 | 2/1976 | United Kingdom | 416/191 X |

*Primary Examiner*—Everette A. Powell, Jr.

*Attorney, Agent, or Firm*—Cushman, Darby & Cushman

[57] ABSTRACT

A blade or vane for a gas turbine engine has a cooled shroud made of two pieces, one of which is integral with the aerofoil and has formed on its surface distant from the aerofoil a plurality of convoluted grooves. The second piece overlays the first and closes the open faces of the grooves to form convoluted passages which are fed with cooling fluid from duct means.

6 Claims, 3 Drawing Figures

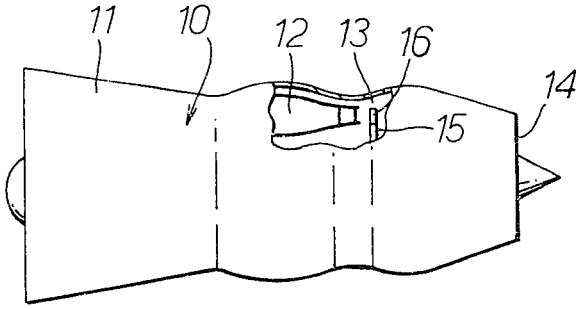
Fig. 1
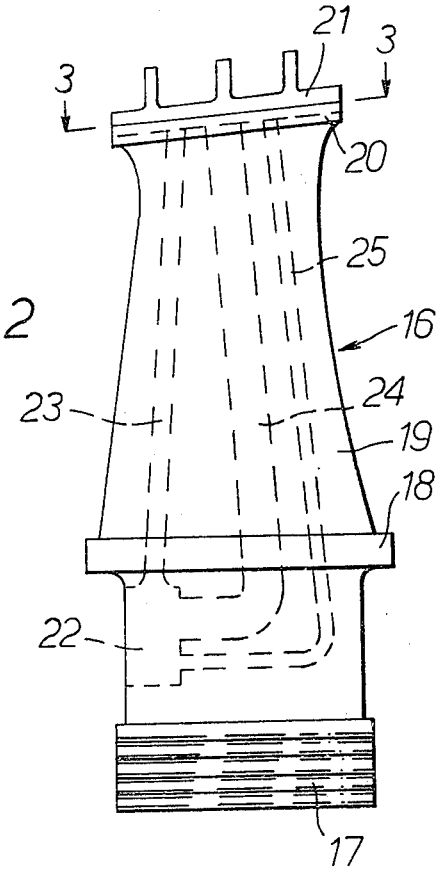
Fig. 2
Fig. 3
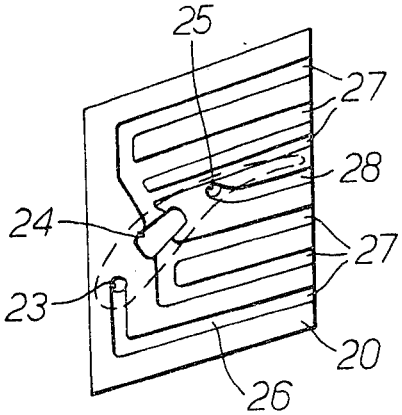

BLADE OR VANE FOR A GAS TURBINE ENGINE

This invention relates to a blade or vane for a gas turbine engine.

Such blades or vanes are frequently provided with platforms, shrouds or other similar pieces which make up or form part of the annulus within which the gas flow of the engine is constrained to flow. Such portions are not subject to the highest temperature of the gas flow of the engine, and it has only been in recent years that the practice of providing cooling systems for them has been widely followed. Because of their thinness and the necessity to maintain their weight as low as possible, it has been difficult to find a construction which allows adequate cooling while maintaining light weight and being easy to manufacture.

The present invention provides a construction which at least partly satisfies these requirements.

According to the present invention a blade or vane for a gas turbine engine comprises an aerofoil section and at least one shroud or platform, said shroud or platform being made of two pieces, a first, gas contacting piece formed integral with the aerofoil and having in its surface distant from the aerofoil a convoluted pattern of grooves, and a second piece which overlays the first piece so as to close the open faces of the grooves to form passages, and duct means adapted to supply cooling fluid to the convoluted passages thus formed.

Preferably the convoluted passages are fed with the cooling fluid which has passed through the aerofoil, and at least some of the passages may end in orifices formed at the trailing edge of the shroud and through which the spent cooling fluid may be discharged.

The convoluted pattern of grooves may be relatively easily formed by electrochemical machining or by chemical etching and the second piece may be brazed or otherwise metallurgically joined to the first piece.

The invention will now be particularly described, merely by way of example, with reference to the accompanying drawings in which:

FIG. 1 is a partly broken away view of a gas turbine engine having blades in accordance with the invention, FIG. 2 is an enlarged view of one of the blades in accordance with the invention of FIG. 1, and FIG. 3 is a section on the line 3—3 of FIG. 2.

In FIG. 1 there is shown a gas turbine engine comprising a casing 10 within which are mounted in flow series a compressor 11, combustion section 12, turbine 13 and final nozzle 14. Operation of the engine is conventional in that air is taken in, compressed in the compressor 11 and fuel is added to the compressed air and burnt in the combustion section 12. The resulting hot gases drive the turbine 13 which in turn drives the compressor. The spent gases then exhaust through the nozzle 14 to provide propulsive thrust.

The turbine 13 comprises a turbine rotor disc 15 on which are supported a plurality of turbine rotor blades 16; the construction of these blades is elaborated in FIGS. 2 and 3.

It will be seen in FIG. 2 that each blade 16 comprises a root 17 by which it is supported from the disc 15, and which is connected to a platform 18, the platform comprising a part of an annulus so that when a row of the blades are mounted on the disc, the platforms 18 together make up the inner boundary of the flow annulus of the gas turbine. Projecting from the platform 18 there is an aerofoil portion 19 and this aerofoil carries at its tip an integral first shroud portion 20. As in the case of the platform 18 these portions 20 in a row of blades abut together to form a complete annulus which provides the outer boundary of the flow annulus of the engine. The first portion 20 has attached to its outer surface by brazing, a second shroud portion 21.

In order to cool the blades these are provided with integral cooling channels through which cooling air provided from another part of the engine may be passed. In this particular embodiment, the cooling air enters the blade into a manifold chamber 22 adjacent to the root 17 and flows from this manifold chamber 22 through three cooling passages 23, 24 and 25. These passages extend longitudinally from base to tip of the aerofoil section 19. At the tip of the blade the cooling air is used to cool the shroud and to this end the shroud is formed with a plurality of cooling air channels as can best be seen from FIG. 3.

As is shown in FIG. 3 the surface of the shroud piece 20 remote from the aerofoil is provided with a plurality of convoluted grooves which are made up of three groups 26, 27 and 28. The group 26 is arranged to communicate with the outlet of the leading passage 23 and it comprises a single groove which extends in a circumferential direction until it is adjacent the edge of the shroud portion, and then extends rearwardly to break through the rear edge of the shroud portion. The group 27 communicates in a similar manner with the passage 24 and in this case the group comprises two branches, one of which extends towards the front corner of the shroud and branches into three rearwardly extending passages which break through the shroud trailing edge, and a second branch which feeds two rearwardly extending channels adjacent the rearwardly extending portion of the channel 26; these again break out at the rearward edge of the shroud. The final group 28 comprises a single rearwardly extending channel connected to the outlet of the passage 25 and breaking once again through the rear edge of the shroud.

Over the top of these groups of channels, the second shroud portion 21 is brazed. The undersurface of the portion 21 matches closely that of the non cut-away part of the upper surface of the first portion 20, and it is brazed to these portions. In this way the undersurface of the portion 21 forms a closure for the open sides of the groups of convoluted channels making these effectively consoluted ducts.

Operation of this construction is simply that cooling air is fed to the manifold chamber 22 from where it passes up the channels 23, 24 and 25 through the aerofoil, taking heat from the metal of the blade as it passes. When it has cooled this aerofoil portion, the cooling air enters its respective group of channels and flows through them to remove heat from the shroud. The air which passes up the channels 23 and 25 has the greatest amount of heat to extract since these channels are adjacent the extremities of the aerofoil where the heating is more severe. This air is therefore less able to provide efficient cooling than the air which passes up the intermediate passage 24. Therefore the groups of passages in the shroud which are supplied by the three aerofoil passages differ in area of shroud covered; groups 26 and 28 only comprise single passages while the group 27 includes five branches.

Once the air has passed through the respective passages in the shroud it exhausts through the trailing edge where all of the shroud passages break out to form dicharge apertures.

It will be appreciated that a number of modifications of the described embodiment could be made. Thus although described in relation to a rotor blade the construction would be equally applicable to stators; again it would be possible to make the inner platform 18 with cooling of this nature. The particular disposition of channels shown is obviously amenable to alteration to suit specific cases, and of course the system described for cooling the aerofoil is very simple and could be replaced by a more sophisticated arrangement in a blade, subject to very high temperatures.

It should also be noted that the channels described are relatively simple to make, either by casting them when the blade plus shroud is cast, or by a subsequent chemical etching or electrochemical or electrodischarge machining of the otherwise flat surface of the shroud.

It will also be understood that cooling fluids other than air could well be used in the blade or vane in accordance with the invention.

I claim:

1. A blade or vane for a gas turbine engine comprising: an aerofoil section and at least one shroud member, said shroud member including a first gas contacting piece and a second piece secured to said first piece, said first gas contacting piece being integral with said aerofoil section and having one surface adjacent said aerofoil section and another surface distant from said aerofoil section having a convolute pattern of open-faced grooves formed therein over substantially the whole area thereof, said second piece, when secured to said first piece, being positioned to overlie and close the open face of said grooves to form a plurality of passages having an opening to the exterior of said shroud member, said passages being divided into a plurality of individual groups, and a plurality of cooling ducts extending through said aerofoil section for supplying cooling fluid to said passages, a different one of said ducts being arranged to feed each of said plurality of groups of passages individually of another of said groups of passages.

2. A blade or vane as claimed in claim 1 and in which a first said duct lies adjacent an edge of the aerofoil and a second said duct lies in the mid-section of the aerofoil, the group of convoluted passages fed from the first said duct being smaller in extent than the group fed from the second said duct.

3. A blade or vane as claimed in claim 1 and in which at least some of said convoluted passages end in orifices formed at the trailing edge of the shroud and through which spent cooling fluid may be discharged.

4. A blade or vane as claimed in claim 1 and in which said convoluted grooves are chemical etched grooves.

5. A blade or vane as claimed in claim 1 and in which said convoluted grooves are electrochemical machined grooves.

6. A blade or vane as claimed in claim 1 and in which said second piece is attached to said first piece by brazing.

* * * * *